US005996888A

United States Patent [19]

Gromatzky

[11] Patent Number: 5,996,888

[45] Date of Patent: Dec. 7, 1999

[54] TAMPER-RESISTANT CASH ACCEPTOR FOR SECURELY STORING PAPER CURRENCY IN A DISPENSER APPARATUS

[75] Inventor: Jonathan A. Gromatzky, Blacksburg, Va.

[73] Assignee: Gilbarco Inc., Greensboro, N.C.

[21] Appl. No.: 09/069,572

[22] Filed: Apr. 29, 1998

[51] Int. Cl.[6] ..... G07B 15/00

[52] U.S. Cl. ..... 232/15; 232/1 D; 232/16; 222/2; 194/350; 194/206

[58] Field of Search ..... 232/15, 16, 1 D, 232/31, 32; 194/206, 350; 222/2

[56] References Cited

U.S. PATENT DOCUMENTS

| | | | |
|---|---|---|---|
| 3,845,848 | 11/1974 | Robbins | 222/2 X |
| 4,434,931 | 3/1984 | Hunt et al. | 232/15 |
| 4,949,901 | 8/1990 | Harris | 232/16 X |
| 5,533,605 | 7/1996 | Mays et al. | 232/15 X |
| 5,676,231 | 10/1997 | Legras et al. | 194/206 |
| 5,700,195 | 12/1997 | Halic | 194/350 X |

*Primary Examiner*—Terry Lee Melius
*Assistant Examiner*—William L. Miller
*Attorney, Agent, or Firm*—Jenkins & Wilson, P.A.

[57] ABSTRACT

A tamper-resistant cash acceptor for paper currency is provided for use with dispensing apparatus, and more particularly fuel dispensing apparatus. The tamper-resistant cash acceptor comprises a cash acceptor with forwardly removable cash cassette, a mounting bracket, a door actuator mechanism, and a locking mechanism. The cash acceptor can be moved relative to the mounting bracket from a forwardly oriented operating position to a lowered and rearwardly oriented cash cassette removal position and cash acceptor servicing position by movement of the door actuator mechanism from an upright and closed position to a laterally extending and open position. The locking mechanism is operatively associated with the door actuator mechanism and serves to interlockingly engage together the door actuator mechanism, the mounting bracket, and the cash acceptor when the cash acceptor is positioned in its forward and raised operating position in order to prevent access to the cash acceptor.

18 Claims, 7 Drawing Sheets

TAMPER-RESISTANT CASH ACCEPTOR FOR SECURELY STORING PAPER CURRENCY IN A DISPENSER APPARATUS

TECHNICAL FIELD

The present invention relates generally to an improved tamper-resistant cash acceptor of the type having a removable cash cassette. More particularly, the present invention relates to an improved tamper-resistant cash acceptor of the type having a removable cash cassette wherein said cash acceptor moves between a tamper-resistant raised and forwardly oriented operating position and a lowered and rearwardly oriented cash cassette removal position by means of a novel bracket and safety door actuator mechanism.

RELATED ART

As of interest, representative prior art patents include U.S. Pat. No. 3,845,848 to Robbins that discloses a fuel dispenser having a cash or bill acceptor box formed therein wherein the bill acceptor is indicated to be any one of a number of mechanisms that are commercially available. The cash acceptor is mounted within a fuel dispenser adjacent a top portion thereof as shown in the drawings. U.S. Pat. No. 5,533,605 to Mays et al. discloses a cash box securement and access device for a paper currency handler. The device makes use of a security plate which operates in conjunction with the locking mechanism within the cash box to enable the cash box lock to be unlocked from the apparatus housing when the security plate is fully in place so as to cover the currency window. Accordingly, the cash box cannot be removed from the stacker apparatus until the security plate is fully in place in a sealing position enclosing the window. U.S. Pat. No. 4,434,931 to Hunt et al. discloses a cash box for stacked paper currency which has a closure that prevents separation of the cash box bill accepting unit whenever that closure is in its open position and that must be moved to, and locked in, its closed position whenever the cash box is to be separated from the bill acceptor. The closure consists primarily of the slide plate and its relationship with the housing. U.S. Pat. No. 4,949,901 to Harris discloses a self-locking bill accumulator with outer and inner locks wherein rotation of an outer lock by a key is required in order to detach and remove the bill accumulator from the associated dollar bill processing machine. Rotation of the outer lock occurs prior to removal of the bill accumulator and causes a corresponding rotation of an inner lock which positively locks the bill accumulator to protect bills in the accumulator from theft after removal. Subsequent to removal, the outer lock becomes disengaged from the inner lock so that a separate key is required in order to unlock the bill accumulator and therefore remove the paper currency. However, none of these references are believed to disclose applicant's novel tamper-resistant cash acceptor, but they are believed to primarily serve as representative references relating to cash acceptors for fuel dispensers and the like that have been known heretofore.

Thus, cash acceptors with removable cash cassettes are now well known for use in combination with a wide variety of dispensing apparatus. It is well known in modern fuel dispensers to have a cash acceptor used therewith which will allow a customer to insert one dollar, two dollar, five dollar, ten dollar and or 20 dollar paper currency in order to provide pay-at-the-pump convenience to cash customers requiring fuel for an automobile or other vehicle. The cash acceptor is many times used in combination with a card acceptor that will allow a customer to pay at the fuel pump with a credit card. Both of these features are particularly advantageous in a fuel dispensing apparatus (e.g., a gasoline pump) in order to minimize customer time and effort required to fuel an automobile or other vehicle.

Cash acceptors serve many useful functions including deterring customers from obtaining fuel and then driving off without paying the proprietor. Typically, a cash acceptor is designed with a removable, lockable cash cassette that can be removed by a store manager and/or picked up by an armored carrier. Unfortunately, all known efforts to provide security against unauthorized removal of stacked paper currency in the cash cassette have been less than successful in stopping a determined thief. Representative state of the art cash acceptors include JCM Model No. DBV-45-GS available from Japan Cash Machine Co., Ltd. However, applicant believes that all known cash acceptors with removable cash cassette units possess shortcomings with respect to security from unauthorized tampering. Applicant has developed a new tamper-resistant cash acceptor with a removable cash cassette that is believed to provide exceptional resistance to tampering and theft of paper currency stored therein. Moreover, applicant's novel cash acceptor provides both greater ease of cash cassette removal and cash acceptor servicing when located in a dispensing apparatus than has been known heretofor.

Although the present invention is described with particular reference to use in a fuel dispensing apparatus, applicant wishes to note that the novel cash tamper-resistant cash acceptor of the present invention is intended for use in any type of dispensing apparatus for which a cash acceptor is required.

DISCLOSURE OF THE INVENTION

The apparatus of the present invention provides a tamper-resistant cash acceptor for securely storing a stack of paper currency within the cash acceptor when used in combination with a dispensing apparatus such as a fuel dispenser (e.g., a gas pump). The cash acceptor provides greatly enhanced security and resistance to tampering as well as a convenient cash cassette removal position and cash acceptor service position. The improvements are achieved through the use of a novel mounting bracket and locking mechanism with a cash acceptor of the type having a cash cassette that is removed from the front of the cash acceptor.

The cash acceptor comprises a mounting bracket adapted to be fixedly mounted within a dispensing apparatus. The cash acceptor including a forwardly removable cash cassette is mounted to its mounting bracket in such a fashion as to be selectively movable between a raised and forwardly oriented operating position and a lowered and rearwardly oriented cash cassette removal position. A door actuator mechanism is provided that includes a door pivotably mounted to the front of the mounting bracket to provide a protective cover for the cash acceptor, and the door actuator mechanism is adapted for selectively moving the cash acceptor from the raised forward operating position to the lowered rearward cash cassette removal position as the door actuator mechanism is moved from its closed position to its open position, respectively.

Further, a locking mechanism is provided that is operatively associated with the door actuator mechanism for releasably locking together the door actuator mechanism, the mounting bracket and the cash acceptor means when the cash acceptor means is positioned in the raised forward operating position. Also, the door actuator mechanism is adapted so as to also provide a cash acceptor service position when the cash acceptor is in the lowered rearward cash cassette removal position such that the cash acceptor can be pivoted upwardly therefrom into the service position to provide access to modular components that can be removed or replaced without removing the entire cash acceptor. The movement of the cash acceptor from the rearwardly oriented cash cassette removal position to the cash acceptor service position requires only a minimal pivotal upward movement of the front of the cash acceptor.

It is therefore the object of the present invention to provide an improved cash acceptor with greatly enhanced resistance to tampering and theft of a stack of paper currency contained therewithin.

It is another object of the present invention to provide an improved cash acceptor wherein the cash cassette is substantially unremovable even if the protective door of the cash acceptor is broken into or removed.

It is another object of the present invention to provide an improved cash acceptor that is adapted to move between an operating position, a cash cassette removal position and a cash acceptor service position wherein the cash cassette is extraordinarily secure in the operating position and the cash cassette can be simply and quickly removed in the cash cassette removal position and of the cash acceptor can be easily serviced in the service position.

Some of the objects of the invention having been stated, other objects will become evident as the description proceeds, when taken in connection with the accompanying drawings described below.

BEST MODE FOR CARRYING OUT THE INVENTION

Figure 1:
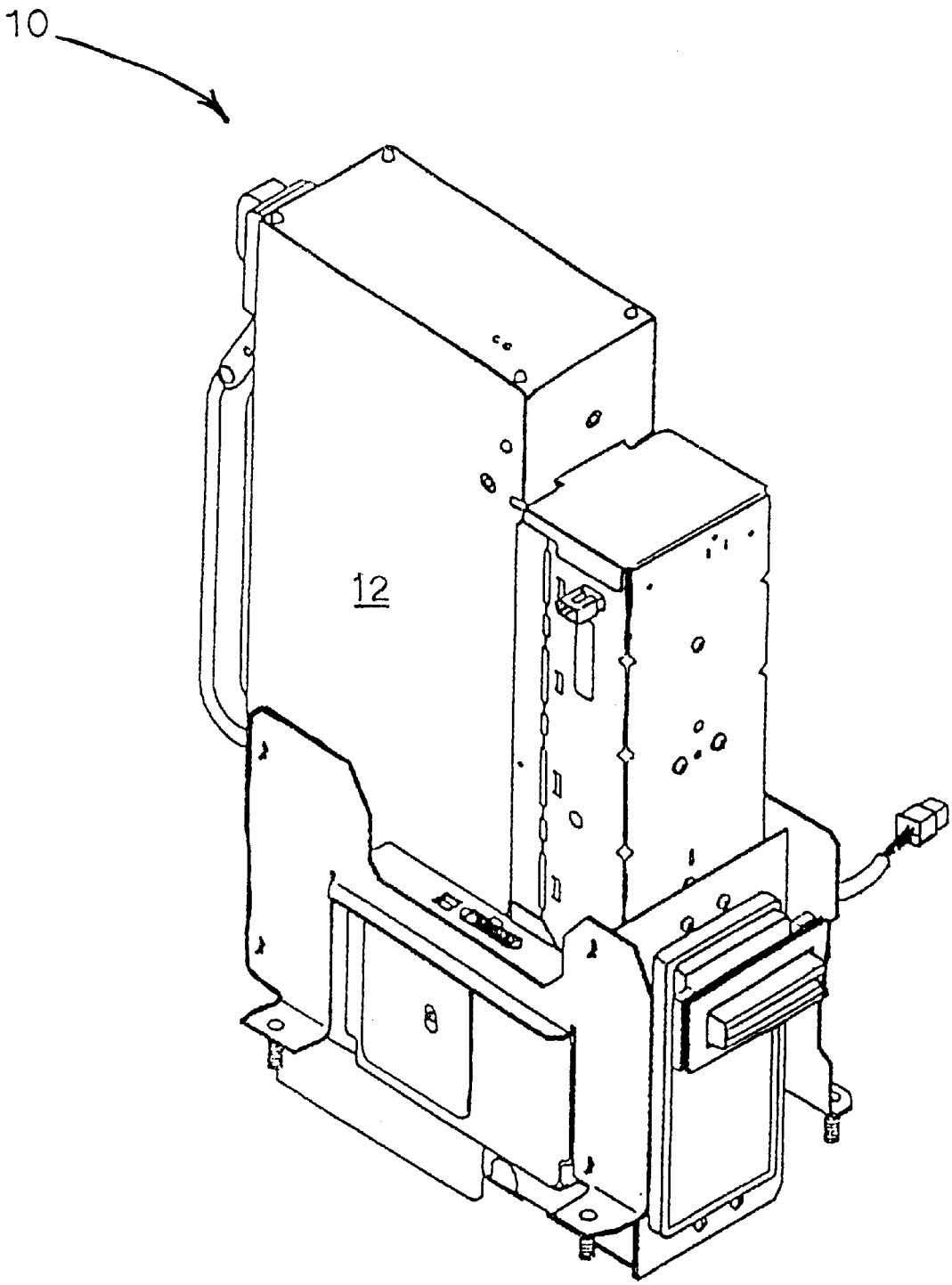
Fig. 1 (PRIOR ART)
FIG. 1 is a perspective view of a prior art cash acceptor with a rearwardly removable cash cassette.
Figure 2A:
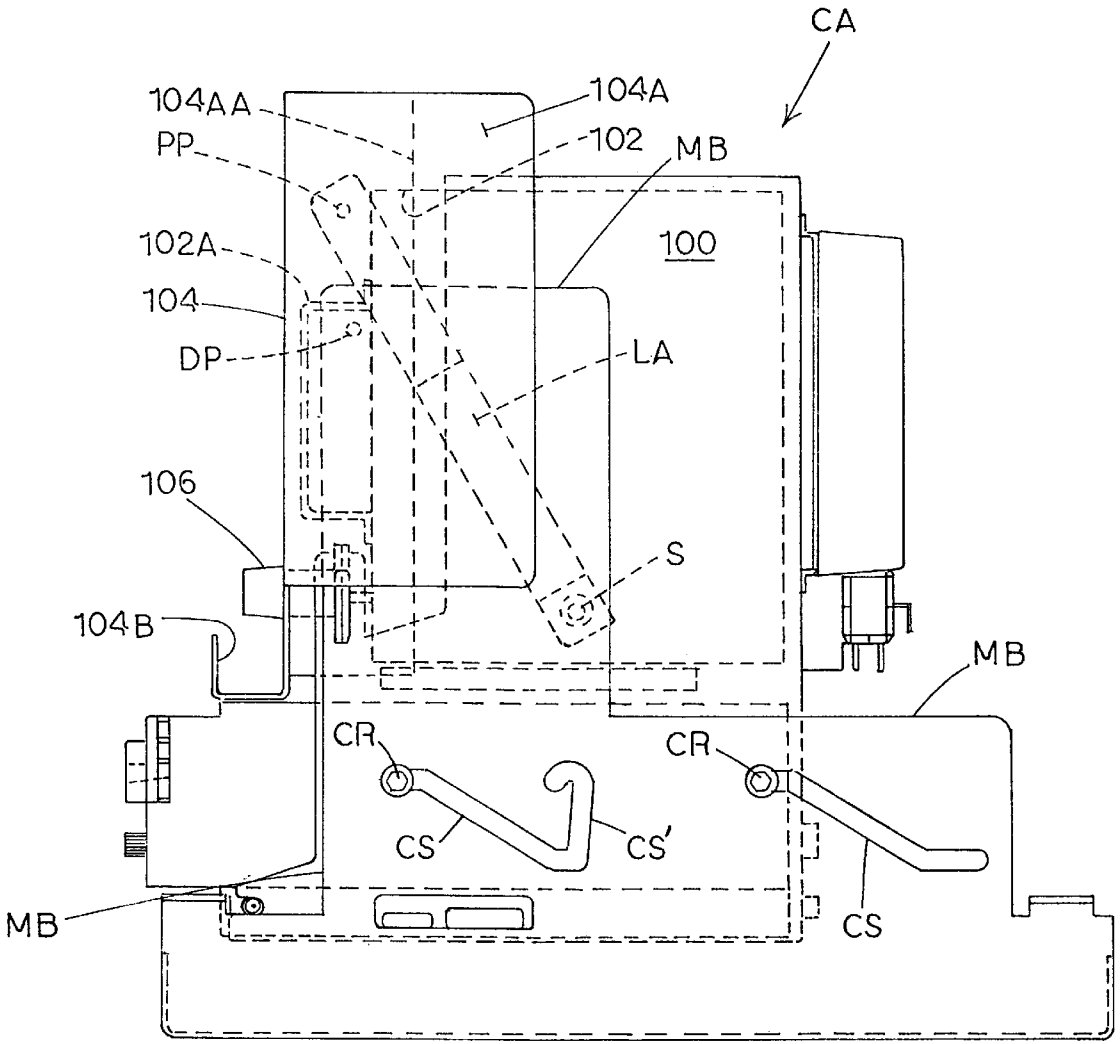
FIGS. 2A–2D are side elevation views of the cash acceptor of the present invention showing raising of the protective door of the door actuator mechanism from the closed to the open position and the corresponding movement of the cash acceptor from the raised and forwardly oriented operating position to the lowered and rearwardly oriented cash cassette removal position and cash acceptor service position.
Figure 2B:
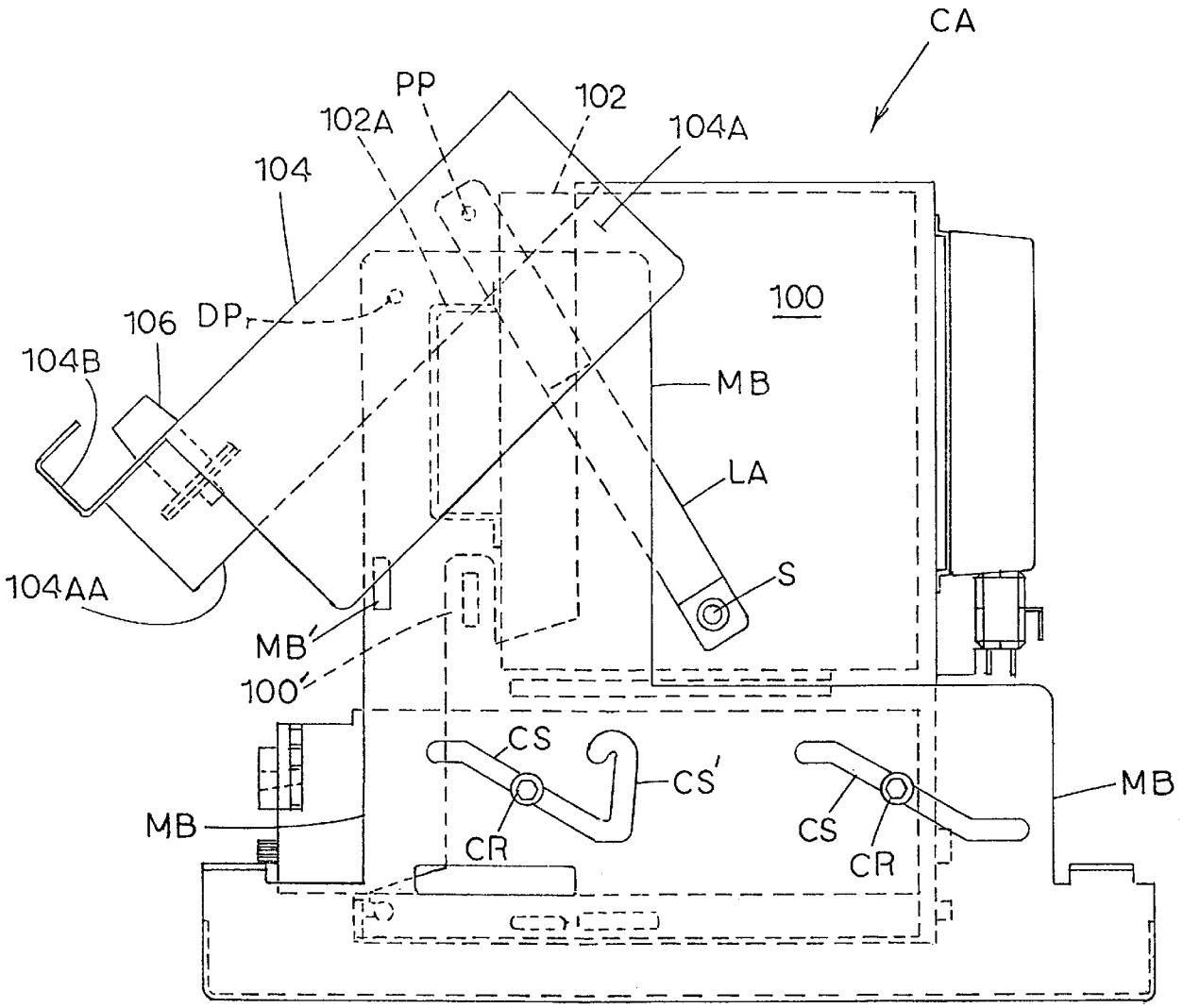
Figure 2C:
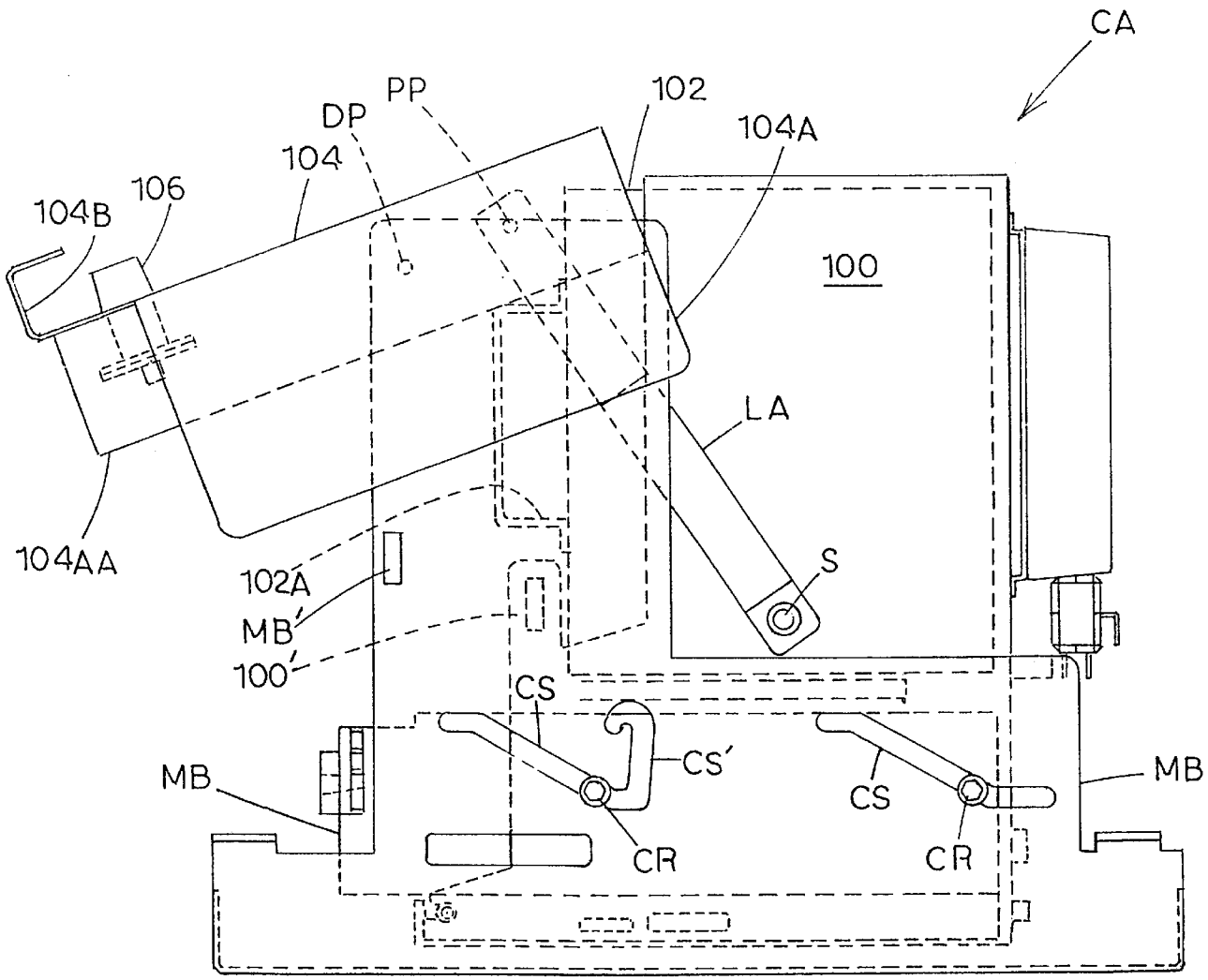
Figure 2D:
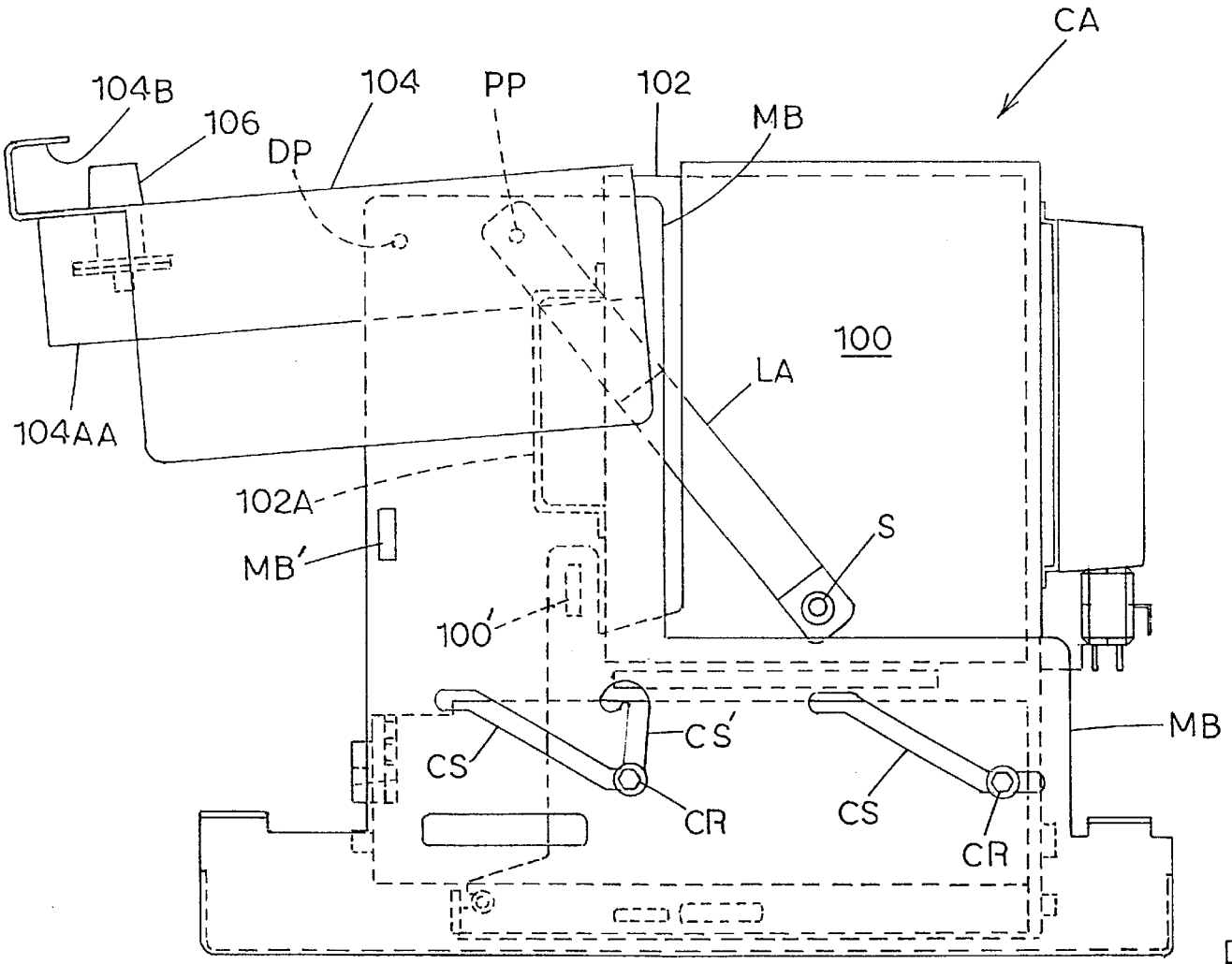

Referring now more specifically to the drawings, a conventional cash acceptor with a rearwardly removable cash cassette is shown in FIG. 1 of the drawings. The cash acceptor is generally designated 10 and the lockable and rearwardly removable cash cassette is designated by the numeral 12. As is well known in the art, this type of cash acceptor suffers significant shortcomings relating to security and poor serviceability. For example, it is well known that this type of cash acceptor can be accessed and the cash cassette removed by use of a crowbar or similar device on the cash acceptor while located in a fuel dispensing apparatus or similar dispensing-type apparatus. Applicant has overcome the shortcomings of prior cash acceptors with the tamper-resistant cash acceptor according to the present invention. Applicant's new tamper-resistant cash acceptor provides greater security when the cash acceptor is in the operating position while rendering the everyday processes of removing the cash cassette and servicing the cash acceptor easier and simpler when the apparatus is in the cash cassette removal position and cash acceptor service positions, respectively.

Referring now to FIGS. 2A–2D and 3A–3B, applicant's tamper-resistant cash acceptor apparatus is shown and generally designated CA. Cash acceptor apparatus CA of the present invention comprises cash acceptor 100 and forwardly removable cash cassette 102 mounted in the front thereof wherein the cash cassette includes handle 102A extending outwardly from the face of the cash cassette. Cash acceptor 100 is movably mounted within mounting base MB consisting of parallel and spaced-apart sides joined together at the bottom by a transversely extending floor or base (see FIGS. 3A–3B). Cash acceptor 100 is slidably mounted within mounting bracket MB so as to be capable of movement from a raised and forwardly oriented operating position to a lowered and rearwardly oriented cash cassette removal position (in which the cash acceptor 100 can also be tilted upwardly for servicing in a cash acceptor service position) in a manner which will be described in detail hereinbelow.

An actuator mechanism is used to slidably position cash acceptor 100 within mounting bracket MB and comprises door 104 having a front plate and opposing sides 104A extending backwardly therefrom and an upturned handle 104B at the bottom of front of door 104. Door 104 of the actuator mechanism includes a lever arm LA located on each side of cash acceptor 100 and each lever arm LA is secured at its upper end with a normally outwardly biased pivot pin PP to a spaced-apart inner plate 104AA adjacent and parallel to a portion of each side 104A of door 104. Each lever arm LA extends downwardly and rearwardly of door 104 and is pivotably secured to a corresponding side of cash acceptor 100 with a suitable fastener such as braid or screw S. In this fashion, two lever arms LA are connected at their upper ends to door 104 and at their lower ends to cash acceptor 100 so as to urge cash acceptor 100 downwardly and rearwardly through mechanical advantage obtained when door 104 is urged upwardly from its closed position to its fully open position so as to cause door 104 to pivot about door pivots DP which act as a hinge. Door pivots DP are clinch shoulder studs mounted through each side of mounting bracket MB and each corresponding door inner plate 104AA. The moment force produced about the hinge formed by door pivots DP is transmitted to cash acceptor 100 by lever arms LA so as to push the cash acceptor 100 rearwardly and downwardly.

The pathway of movement of cash acceptor 100 when door 104 is raised from its closed to its fully open position will be determined by two cam slots CS defined within each opposing side of mounting bracket MB. The pair of cam slots on each side of mounting bracket MB are each generally rearwardly and downwardly oriented and will urge the corresponding pair of cam rollers CR fixedly secured to each side of cash acceptor 100 and extending into cam slots CS into a generally downward and rearward pathway defined by cam slots CS. Thus, when door 104 is raised the moment force produced about the hinge defined by door pivots DP is transmitted to cash acceptor 100 by lever arms LA which translate the cash acceptor 100 downwardly and rearwardly along the pathway of the pair of cam slots CS defined in each side of mounting bracket MB. Applicant notes that the mechanical advantage provided by door 104 is constant and based entirely on leverage provided by lever arms LA, and the total mechanical advantage varies with each position described herein and will serve to hold door 104 up when released without the necessity for a spring or the like. Further, applicant notes that the forwardmost cam slot CS on each side of mounting bracket MB includes an upwardly extending slot pathway at the lowermost end thereof which is designated CS' in the drawings. The upwardly extending portion CS' of each forwardmost cam slot CS on opposing sides of mounting bracket MB serves to allow upwardly tilting and orienting cash acceptor 100 into a service position when cash acceptor 100 is in its rearwardly and downwardly oriented cash cassette removal position. This aspect of the inventive tamper-resistant cash acceptor 100 will be described in more detail hereinbelow.

Figure 3A:
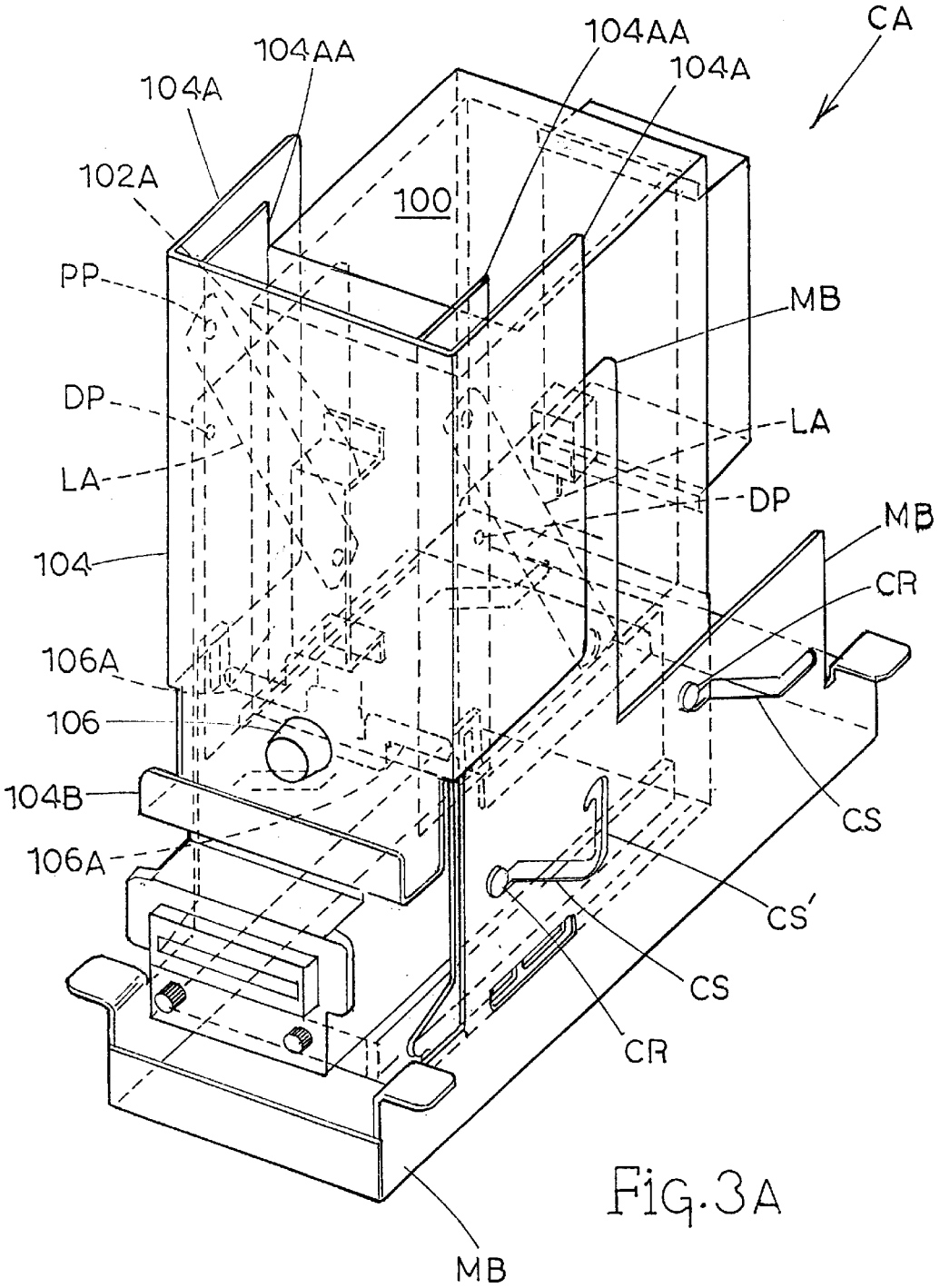
FIGS. 3A–3B are perspective views of the cash acceptor of the present invention wherein the protective door of the door actuator mechanism is raised from the closed to the open position and the corresponding movement of the cash acceptor from the raised and forwardly oriented position to the lowered and rearwardly oriented cash cassette removal position and cash acceptor service position.
Figure 3B:
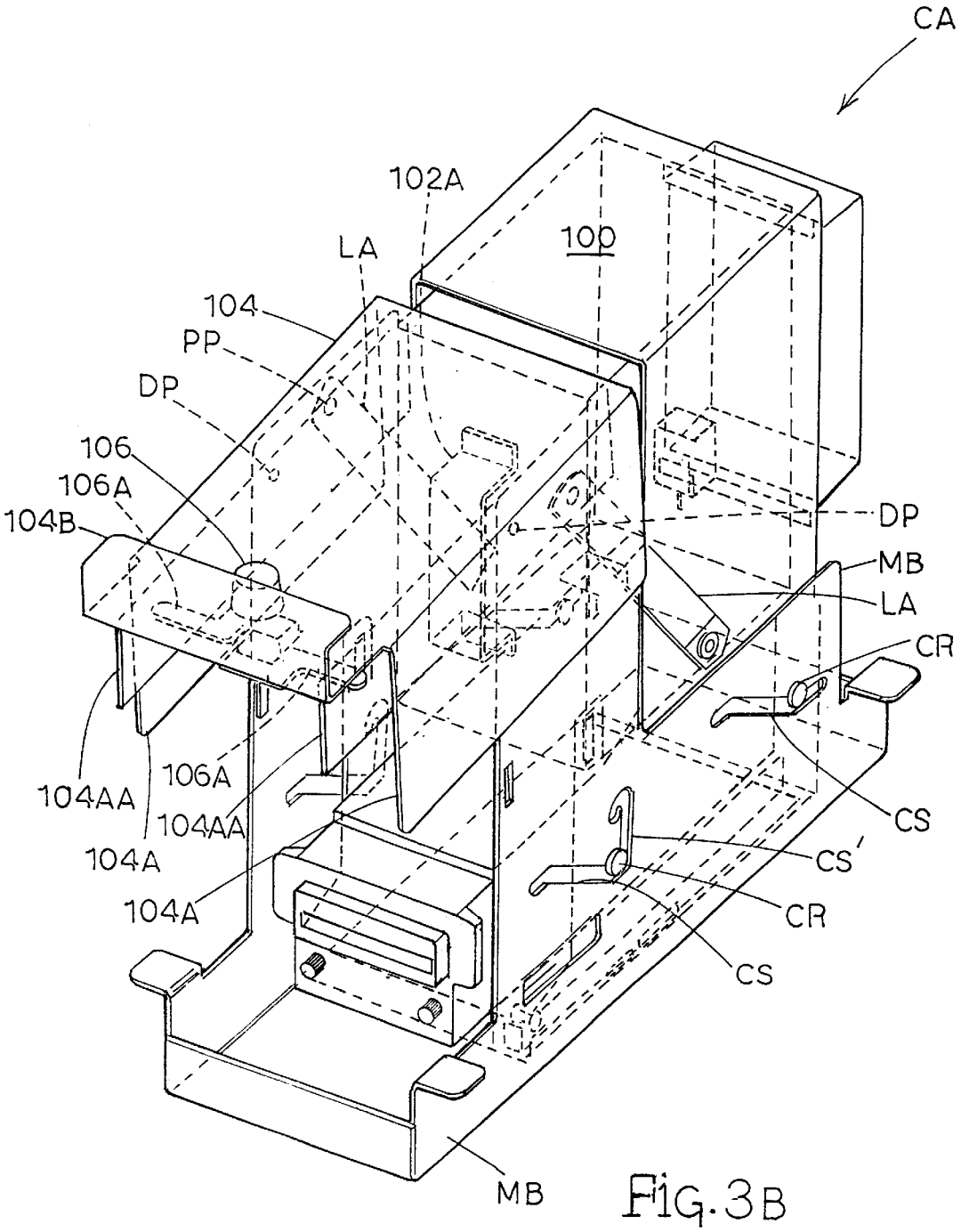

A novel locking mechanism is used with applicant's novel cash acceptor 100 and comprises a key lock 106 mounted in the lower portion of door 104 and including a cam and lever mechanism that acts to translate a pair of levers 106A see FIGS. 3A and 3B outwardly and through a slot 100' on each side of cash acceptor 100 and a slot MB' on each side of the mounting bracket (see FIGS. 2B–2D) so as to secure door 104 and the related parts of the actuator mechanism to cash acceptor 100 and mounting bracket MB at both sides of the mounting bracket when the cash acceptor 100 is in its raised and forward operating position. Also, locking mechanism 106 of cash acceptor 100 utilizes normally outwardly biased pivot pins PP at the top of each lever arm LA in order to provide a stop element immediately adjacent each side of cash cassette 102 to prevent forward removal of the cash cassette when cash acceptor 100 is in its operating position. Pivot pins PP on opposing sides of door 104 are urged inwardly when door 104 is moved from its open position (see FIG. 2D and 3B) to its fully closed position (see FIG. 2A and 3A) since each lever arm LA defines a shoulder in the medial portion thereof such that the bottom length of each lever arm LA is spaced outwardly from the upper length of each lever arm LA. The shoulder in the medial portion of each lever arm LA therefore comes into contact with a respective side of mounting bracket MB as the door is moved from its uppermost to its lowermost position and the contact therebetween urges lever arm LA inwardly so as to consequently urge normally outwardly biased pivot pins PP at the top of lever arms LA into the removal pathway of cash cassette 102. This part of the locking mechanism acts in conjunction with key lock 106 to lock door 104 and its associated actuator mechanism, cash acceptor 100 and mounting bracket MB together into an interlocking relationship which substantially renders cash acceptor 100 tamper-proof when door 104 has been lowered into its lowermost position and key lock 106 secured into a locked position by its associated key.

METHOD OF OPERATION

In its preferred embodiment, applicant's tamper-resistant cash acceptor apparatus CA is intended to be mounted within a dispensing apparatus in such a way that the internal structure of the dispensing apparatus renders it substantially impossible to remove cash acceptor 100 when door 104 is closed and locked and cash acceptor 100 is in its forward and raised operating position. For example, on a typical fuel dispensing apparatus mounting bracket MB of cash acceptor 100 can be mounted within the fuel dispenser in order to render it virtually impossible to remove cash acceptor 100 when it is in its forward and raised operating position since it will then be wedged against internal structure of the fuel dispenser.

When cash acceptor 100 is in the operating position, door 104 is closed in front of cash cassette 102, key lock 106 is locked and the cam thereof has urged levers 106A into slots 100' and MB' on opposing sides of cash acceptor 100 and mounting bracket MB, and pivot pins PP of lever arms LA have been urged inwardly into the path of cash cassette 102 so as to releasably interlock cash acceptor 100, mounting bracket MB and door 104 and its related actuator mechanism. This provides for door 104 to overlap and enshroud the front of the cash acceptor. Cam rollers CR positioned within cam slots CS of mounting bracket MB act to ensure that cash acceptor 100 is in its correct operating position. Door 104 prevents access to key lock 106, cam rollers CR, lever arms LA and cash cassette 102 by pranksters or thieves. Cash acceptor 100 can only be removed by unlocking door 104 and opening it to move cash acceptor 100 into the lower and rearward cash cassette removal position. In its desired use, the movement of cash acceptor 100 from the operating to the lower and rearward cash cassette removal position (and cash acceptor service position) acts to allow the cash acceptor to move clear of internal structure of a fuel dispenser or the like that can serve to further secure cash acceptor 100 in an unmovable position when door 104 has been lowered and cash acceptor 100 moved into its raised and forward operating position.

To achieve the cash cassette removal position and cash acceptor service position, key lock 106 will be unlocked so as to disengage levers 106A from corresponding slots 100' in cash acceptor 100 and slots MB' in mounting bracket MB so as to allow rearward and downward movement of the cash acceptor to begin. Preferably, the key cannot be removed from key lock 106 when unlocked so as to prevent the door from being left unlocked. Door 104 is raised upwardly and pivots about a hinge defined by door pivots DP and the moment force produced about the hinge is transmitted to the cash acceptor by lever arms LA on opposing sides thereof which urge the cash acceptor back and down along the pathway of cam slots CS into the cassette removal position (and cash acceptor service position). When door 104 has been fully elevated so that the shoulder in the medial portion of each lever arm has been translated beyond the corresponding side of mounting bracket MB, pivot pin stop elements PP that have previously obstructed the forward movement of cash cassette 102 are allowed to return to their normally outwardly biased position which is out of the removal pathway of cash cassette 102. In the rearward and downwardly oriented cash cassette removal position, cash cassette 102 can be pulled forwardly with handle 102A and easily removed from cash acceptor 100 and the dispensing apparatus in which it resides. Once the paper currency has been removed therefrom, cash cassette 102 can be returned and replaced into the cash acceptor.

The third position of cash acceptor 100 can be easily achieved from the cash cassette removal position. While in the cash cassette removal position (see FIG. 2D and 3B), the cash acceptor can be easily pivoted upwardly by means of cash cassette handle 102A so as to allow for servicing of cash acceptor 100 (e.g., access to modular components which can be removed or replaced without removing the entire cash acceptor). The maintenance position (not shown) is achievable in view of the upwardly extending pathways CS' of the forwardmost cam slots CS on each side of mounting bracket MB which allow the corresponding cam rollers CR (see FIG. 2D) to be elevated upwardly and locked in the dog legs at the top of cam slot portions CS'. In other words, the front end of cash acceptor 100 is pivoted upwardly and secured within the top dog legs of cam slots CS' and the movement of cash acceptor 100 is about a hinge defined by cam rollers CR positioned in the rearward cam slots CS on each side of mounting bracket MB which do not allow further movement of cam rollers therewithin (see FIG. 2D). When it is desired to return cash acceptor 100 to its operating position, the cash acceptor is removed from the dog legs of cam slot pathways CS' and allowed to move downwardly into the lower ends of the cam slot pathways of the two opposing rearwardmost located cam slots CS. Next, door 102 is lowered so as to translate the cash acceptor forwardly and upwardly along the pathway of each pair of cam slots CS defined in each opposing side of mounting bracket MB. At the top of all four cam slots CS the slots level off to allow cash acceptor 100 to rest in place until the key is turned in key lock 106 which is configured to act to further urge cash acceptor 100 slightly forwardly into its operating position.

Although applicant has described a preferred embodiment of the invention hereinbefore, applicant does not intend to limit the invention only to the preferred embodiment but to encompass all embodiments of the invention as set forth by the scope of the claims appended hereto. Applicant believes that the novelty of the tamper-resistant cash acceptor apparatus CA resides in its novel structure allowing translation of the cash acceptor from a lowered and rearward cash cassette removal position and cash acceptor service position to a forward and raised operating position, and in its novel locking mechanism that serves to render removal of cash acceptor 100 from a dispensing apparatus very difficult (if not substantially impossible) when cash acceptor 100 is subjected to tampering with crowbars, screwdrivers and similar implements that will serve to access conventional cash acceptors.

It will be understood that various details of the invention may be changed without departing from the scope of the invention. Furthermore, the foregoing description is for the purpose of illustration only, and not for the purpose of limitation--the invention being defined by the claims.

What is claimed is:

1. A tamper-resistant cash acceptor for securely storing bills accepted thereby, comprising:

(a) a mounting bracket having a front and a back;

(b) cash acceptor means including a forwardly removable cash cassette wherein said cash acceptor means is mounted to said mounting bracket so as to be selectively movable relative thereto between a raised and forwardly oriented operating position and a lowered and rearwardly oriented cash cassette removal position;

(c) a door actuator mechanism including a door pivotably mounted to the front of said mounting bracket to provide a protective cover for said cash acceptor means, said door actuator mechanism being adapted for selectively moving said cash acceptor means from said raised forward operating position to said lowered rearward cash cassette removal position as said door actuator mechanism is moved from its closed position to its open position, respectively; and (d) locking means operatively associated with said door actuator mechanism for releasably locking together said door actuator mechanism, said mounting bracket and said cash acceptor means when said cash acceptor means is positioned in said raised forward operating position.

2. The tamper-resistant cash acceptor according to claim 1, wherein said cash acceptor means is mounted within said mounting bracket and slidably movable relative thereto.

3. The tamper-resistant cash acceptor according to claim 1, wherein said cash cassette includes a front handle to facilitate forward removal from said cash acceptor means.

4. The tamper-resistant cash acceptor according to claim 1, wherein said door actuator mechanism includes a lever arm attached to each side of said door at one end and wherein the other end of each lever arm is attached to a corresponding side of said cash acceptor means, and said bracket defines two sides with said cash acceptor means slidably movable therebetween and wherein each bracket side includes one or more generally downwardly extending cam slots therein with one or more corresponding cam rollers attached to each corresponding side of said cash acceptor means being slidably positioned therein such that raising said door urges said cash acceptor means downwardly and rearwardly along the pathway of said cam slots from said forward operating position to said lowered rearward cash cassette removal position.

5. The tamper-resistant cash acceptor according to claim 4, wherein at least one of said one or more generally downwardly extending cam slots on each side of said bracket includes an upwardly extending portion at the lower end of the slot pathway such that in said lowered rearward cash cassette removal position said cash acceptor means can be pivoted upwardly into a service position.

6. The tamper-resistant cash acceptor according to claim 1, wherein:

(a) said door actuator mechanism includes a lever arm attached to each side of said door at one end and wherein the other end of each lever arm is attached to a corresponding side of said cash acceptor means;

(b) said locking means comprises a key lock mechanism in said door of said door actuator mechanism including cam and lever means to secure said door to said bracket, and a normally inwardly biased pivot pin stop element at said one end of each lever arm for preventing removal of said cash cassette when said cash acceptor means is in its raised forward operating position; and (c) said stop elements are withdrawn outwardly by said lever arms when said door is opened and said cash acceptor means is moved to its lowered rearward position so as to allow forward removal of said cash cassette.

7. A tamper-resistant cash acceptor for securely storing bills accepted thereby, comprising:

(a) a mounting bracket having a front and a back, and wherein said mounting bracket includes two opposing sides;

(b) cash acceptor means including a forwardly removable cash cassette wherein said cash acceptor means is mounted within said mounting bracket so as to be slidably movable relative thereto between a raised and forwardly oriented operating position and a lowered and rearwardly oriented cash cassette removal position and cash acceptor means service position;

(c) a door actuator mechanism including a door pivotably mounted to the front of said mounting bracket to provide a protective cover for said cash acceptor means, said door actuator mechanism including means for selectively moving said cash acceptor means from said raised forward operating position to said lowered rearward cash cassette removal position and cash acceptor means service position as said door actuator mechanism is moved from its closed position to its open position, respectively; and (d) locking means operatively associated with said door actuator mechanism for releasably locking together said door actuator mechanism, said mounting bracket and said cash acceptor means when said cash acceptor means is positioned in said raised forward operating position.

8. The tamper-resistant cash acceptor according to claim 7, wherein said cash cassette includes a front handle to facilitate forward removal from said cash acceptor means.

9. The tamper-resistant cash acceptor according to claim 7, wherein said door actuator mechanism includes a lever arm attached to each side of said door at one end and wherein the other end of each lever arm is attached to a corresponding side of said cash acceptor means, and wherein each opposing side of said mounting bracket includes one or more generally downwardly extending cam slots therein with one or more corresponding cam rollers attached to each corresponding side of said cash acceptor means being slidably positioned therein such that raising said door urges said cash acceptor means downwardly and rearwardly along the pathway of said cam slots from said forward operating position to said lowered rearward cash cassette removal position and cash acceptor means service position.

10. The tamper-resistant cash acceptor according to claim 9, wherein at least one of said one or more generally downwardly extending cam slots on each side of said bracket includes an upwardly extending portion at the lower end of the slot pathway such that in said lowered rearward cash cassette removal position said cash acceptor means can be pivoted upwardly into said cash acceptor means service position.

11. The tamper-resistant cash acceptor according to claim 7, wherein:

(a) said door actuator mechanism includes a lever arm attached to each side of said door at one end and wherein the other end of each lever arm is attached to a corresponding side of said cash acceptor means;

(b) said locking means comprises a key lock mechanism in said door of said door actuator mechanism including cam and lever means to secure said door to said bracket, and a normally inwardly biased pivot pin stop element at said one end of each lever arm for preventing removal of said cash cassette when said cash acceptor means is in its raised forward operating position; and (c) said stop elements are withdrawn outwardly by said lever arms when said door is opened and said cash acceptor means is moved to its lowered rearward position so as to allow forward removal of said cash cassette.

12. In combination a fuel dispensing apparatus and a tamper-resistant cash acceptor for securely storing bills accepted thereby, said tamper-resistant cash acceptor comprising:

(a) a mounting bracket adapted to be fixedly mounted within said fuel dispensing apparatus said bracket having a front and a back;

(b) cash acceptor means including a forwardly removable cash cassette wherein said cash acceptor means is mounted to said mounting bracket so as to be selectively movable relative thereto between a raised and forwardly oriented operating position and a lowered and rearwardly oriented cash cassette removal position;

(c) a door actuator mechanism including a door pivotably mounted to the front of said mounting bracket to provide a protective cover for said cash acceptor means, said door actuator mechanism being adapted for selectively moving said cash acceptor means from said raised forward operating position to said lowered rearward cash cassette removal position as said door actuator mechanism is moved from its closed position to its open position, respectively; and (d) locking means operatively associated with said door actuator mechanism for releasably locking together said door actuator mechanism, said mounting bracket and said cash acceptor means when said cash acceptor means is positioned in said raised forward operating position.

13. The tamper-resistant cash acceptor according to claim 12, wherein said mounting bracket is positioned such that said cash acceptor means is wedged against internal structure of said fuel dispensing apparatus when moved into said forward operating position.

14. The tamper-resistant cash acceptor according to claim 12, wherein said cash acceptor means is mounted within said mounting bracket and slidably movable relative thereto.

15. The tamper-resistant cash acceptor according to claim 12, wherein said cash cassette includes a front handle to facilitate forward removal from said cash acceptor means.

16. The tamper-resistant cash acceptor according to claim 12, wherein said door actuator mechanism includes a lever arm attached to each side of said door at one end and wherein the other end of each lever arm is attached to a corresponding side of said cash acceptor means, and said bracket defines two sides with said cash acceptor means slidably movable therebetween and wherein each bracket side includes one or more generally downwardly extending cam slots therein with one or more corresponding cam rollers attached to each corresponding side of said cash acceptor means being slidably positioned therein such that raising said door urges said cash acceptor means downwardly and rearwardly along the pathway of said cam slots from said forward operating position to said lowered rearward cash cassette removal position.

17. The tamper-resistant cash acceptor according to claim 16, wherein at least one of said one or more generally downwardly extending cam slots on each side of said bracket includes an upwardly extending portion at the lower end of the slot pathway such that in said lowered rearward cash cassette removal position said cash acceptor means can be pivoted upwardly into a service position.

18. The tamper-resistant cash acceptor according to claim 12, wherein:

(a) said door actuator mechanism includes a lever arm attached to each side of said door at one end and wherein the other end of each lever arm is attached to a corresponding side of said cash acceptor means;

(b) said locking means comprises a key lock mechanism in said door of said door actuator mechanism including cam and lever means to secure said door to said bracket, and a normally inwardly biased pivot pin stop element at said one end of each lever arm for preventing removal of said cash cassette when said cash acceptor means is in its raised forward operating position; and (c) said stop elements are withdrawn outwardly by said lever arms when said door is opened and said cash acceptor means is moved to its lowered rearward position so as to allow forward removal of said cash cassette.

* * * * *